US005275307A

United States Patent [19]

Freese

[11] Patent Number: 5,275,307

[45] Date of Patent: Jan. 4, 1994

[54] PITCHER WITH LOCKING LID

[75] Inventor: Ross J. Freese, Olathe, Kans.

[73] Assignee: Packer Plastics, Incorporated, Lawrence, Kans.

[21] Appl. No.: 966,459

[22] Filed: Oct. 26, 1992

[51] Int. Cl.[5] ..... B67D 5/22

[52] U.S. Cl. ..... 222/42; 222/153; 222/189; 220/298; 220/324

[58] Field of Search ..... 222/42, 153, 154, 189; 220/298, 324

[56] References Cited

U.S. PATENT DOCUMENTS

| | | | |
|---|---|---|---|
| 254,500 | 3/1882 | Obermann | 222/189 |
| 630,414 | 8/1899 | Schwartz | 222/189 |
| 1,402,517 | 1/1922 | Kuno . | |
| 2,105,201 | 1/1938 | Richheimer | 220/298 |
| 2,544,361 | 3/1951 | Schmitkons | 220/298 X |
| 2,592,279 | 4/1952 | Heier | 222/42 |
| 2,599,332 | 6/1952 | Kirman . | |
| 2,675,040 | 4/1954 | Raun et al. | 220/298 |
| 3,333,738 | 8/1967 | Goss . | |
| 3,362,590 | 1/1968 | Martin . | |
| 3,866,802 | 2/1975 | Birrell . | |
| 4,823,994 | 4/1989 | Laauwe . | |
| 4,887,736 | 12/1989 | VanCucha . | |
| 4,895,281 | 1/1990 | Lorenz . | |

*Primary Examiner*—Gregory L. Huson
*Attorney, Agent, or Firm*—Kokjer, Kircher, Bowman & Johnson

[57] ABSTRACT

A pitcher and a lid that can be locked in place on the pitcher. The upper rim of the pitcher has an outwardly extending lip provided with two diametrically opposed cutouts. The periphery of the lid has two diametrically opposed lugs each provided with a downwardly extending hook. The lid is applied by aligning the lugs with the cutouts so that the hooks can pass through the cutouts. When the lid is then turned, the hooks fit beneath and interlock with the lip to secure the lid in place. Pour openings in the skirt of the lid are offset 90° from the lugs to assure that the lid is in the locked condition when the liquids in the pitcher are poured.

13 Claims, 2 Drawing Sheets

6.

6.

PITCHER WITH LOCKING LID

FIELD OF THE INVENTION

This invention relates generally to pitchers for holding and pouring liquids. More particularly, the invention deals with a pitcher having a removable lid that locks in place in a manner to prevent it from becoming dislodged from the pitcher when liquids are being poured.

BACKGROUND OF THE INVENTION

Beverages of various types have long been contained in pitchers from which the beverages can be conveniently poured into glasses or other containers. In recent years, it has been common for the lids to include skirts that fit down into the top of the pitcher when the lid is in place. The lid is provided with one or more openings that align with the spout when the lid is rotated to the proper position for pouring. When the opening is out of alignment with the spout, the skirt blocks the spout and thereby prevents escape of odors from the contents of the pitcher. The opening in the skirt can take the form of a simple cutout or a plurality of slots that provide a grate structure preventing ice cubes and other solids from being poured along with the liquid. Some lids have both types of openings, and they are usually offset by 180°.

Although this type of pitcher and lid has enjoyed considerable popularity, it has not been wholly free of problems. Perhaps the most notable problem is that the lid is normally retained only loosely on top of the pitcher. While this allows it to be removed easily, it also permits the lid to inadvertently dislodge from the pitcher while the contents are being poured. Consequently, it is often necessary for one hand to be used to hold the lid in place while the other hand is used to pour the liquids from the pitcher. The need to use both hands for pouring of liquids from the pitcher detracts from its convenience.

SUMMARY OF THE INVENTION

The present invention is directed to a pitcher having a lid that can be securely locked in place on top of the pitcher and yet can be quickly and easily released for removal of the lid when the pitcher is to be filled. It is a particularly important feature of the invention that the lid is in the locked condition when it is applied to the pitcher and turned until one of the pour openings is aligned with the spout. This assures that the lid is locked in place when the contents of the pitcher are being poured.

In accordance with the invention, the pitcher is constructed conventionally for the most part but is provided on its top rim with an outwardly projecting lip. Cutouts are formed in the lip at diametrically opposed locations that are adjacent to the handle and to the pour spout of the pitcher. The lid has the usual skirt which presents diametrically opposed openings, one of which is simply a cutout part of the skirt and the other of which takes the form of plural slots providing a grate configuration. A pair of diametrically opposed lugs are formed on the periphery of the lid at locations offset 90° from the openings in the skirt. Each lug is provided with a downwardly extending hook.

In order to secure the lid in place on top of the pitcher, the lid is first oriented such that the lugs are aligned with the cutouts in the lip of the pitcher. The lid can then be applied with the skirt extending into the top of the pitcher and the lugs extending through the cutouts. The lid is then rotated, and the hooks fit beneath and are interlocked with the lip to securely lock the lid in place. Because the lugs on the lid are offset 90° from the pour openings in the skirt, assurance is provided that the lid is locked in place when it is rotated to the pouring position wherein one of the openings is aligned with the spout. The lid can be removed by rotating it until the lugs are aligned with the cutouts and then lifting the lid so that the hooks pass through the cutouts.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
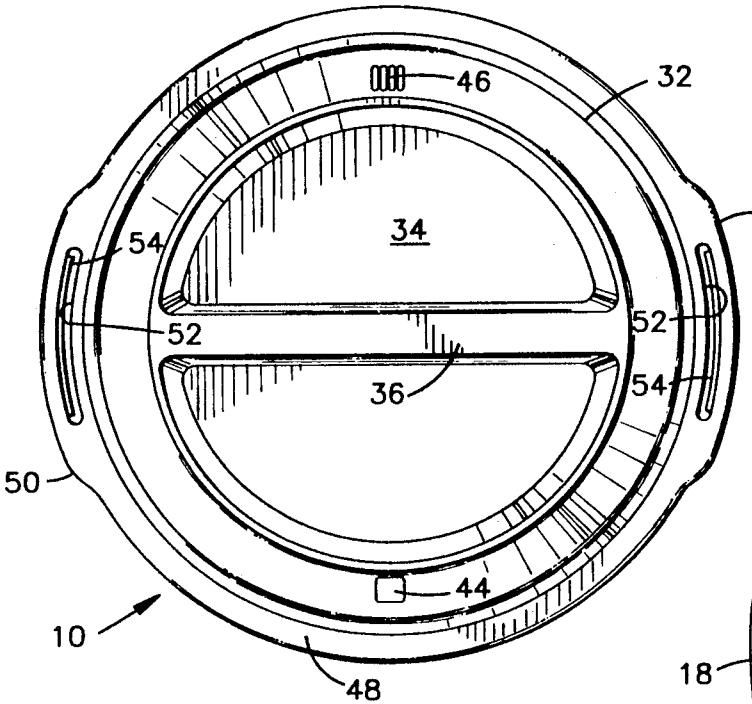
FIG. 1 is a top plan view of a lid which is constructed to lock in place on top of the pitcher in accordance with a preferred embodiment of the present invention.
Figure 3:
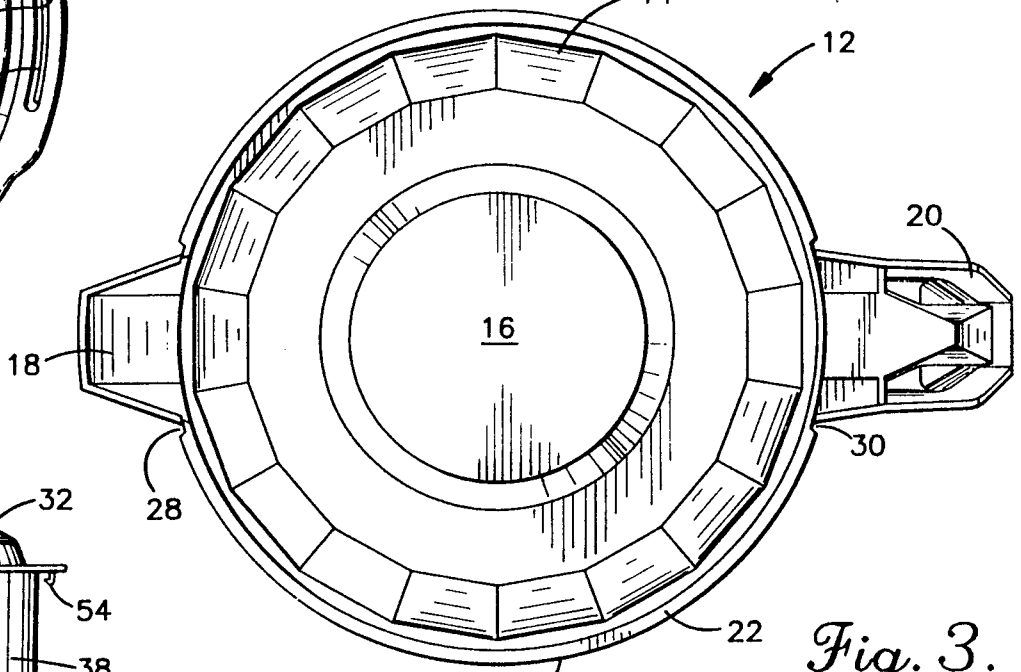
FIG. 3 is a top plan view of a pitcher that is constructed such that the lid can be locked in place on top of the pitcher.
Figure 2:
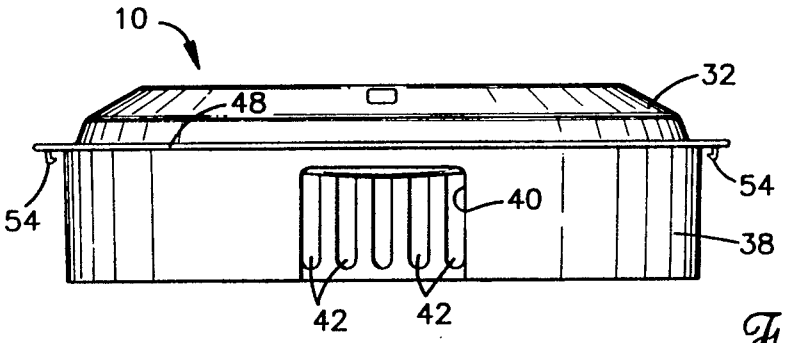
FIG. 2 is a side elevational view of the lid shown in FIG. 1.

Referring now to the drawings in more detail and initially to FIGS. 1–3 in particular, the present invention includes a lid which is generally identified by numeral 10 (FIGS. 1 and 2) and which is constructed to be locked in place on top of a pitcher, generally identified by numeral 12 in FIG. 3. The pitcher 12 is constructed conventionally for the most part and includes a generally cylindrical pitcher body 14 having a fluted side wall. The pitcher body 14 tapers somewhat from top to bottom and presents a hollow interior for receiving and holding beverages and other liquids. The pitcher 12 is open at the top and is provided with a bottom 16 that may be molded integrally as part of the pitcher body 14. A spout 18 is provided adjacent to the top of the pitcher so that liquids can be poured out of the pitcher into glasses and other containers. At a location diametrically opposed to the spout 18, the pitcher body 14 is provided with a handle 20 which may be grasped by the hand and used for pouring of liquids from the container.

Figure 6:
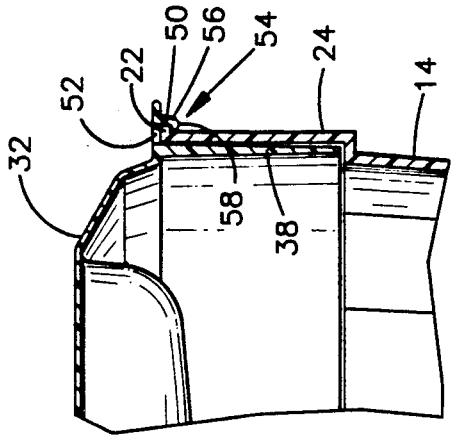
FIG. 6 is a fragmentary sectional view on an enlarged scale taken generally along line 6—6 of FIG. 5 in the direction of the arrows.
Figure 4:
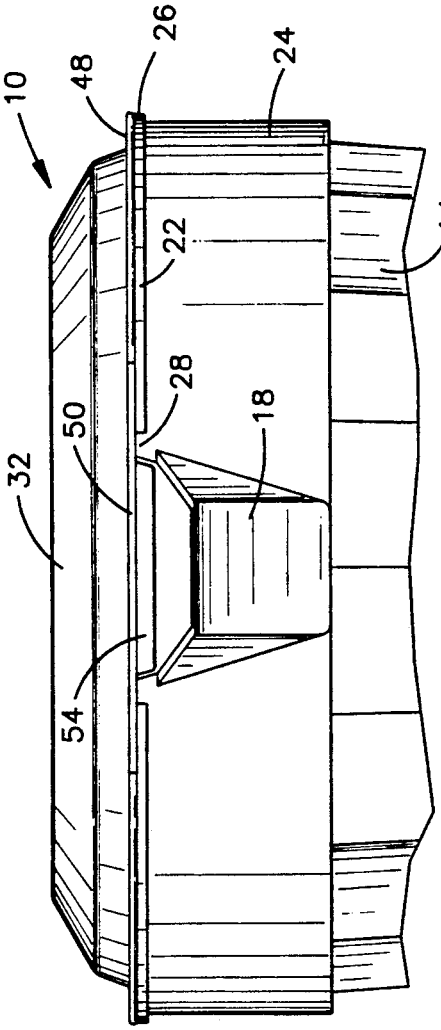
FIG. 4 is a fragmentary front elevational view showing the lid initially applied to the top of the pitcher with one of the hooks on the lid extending through one of the cutouts in the lip on the top rim of the pitcher.
Figure 5:
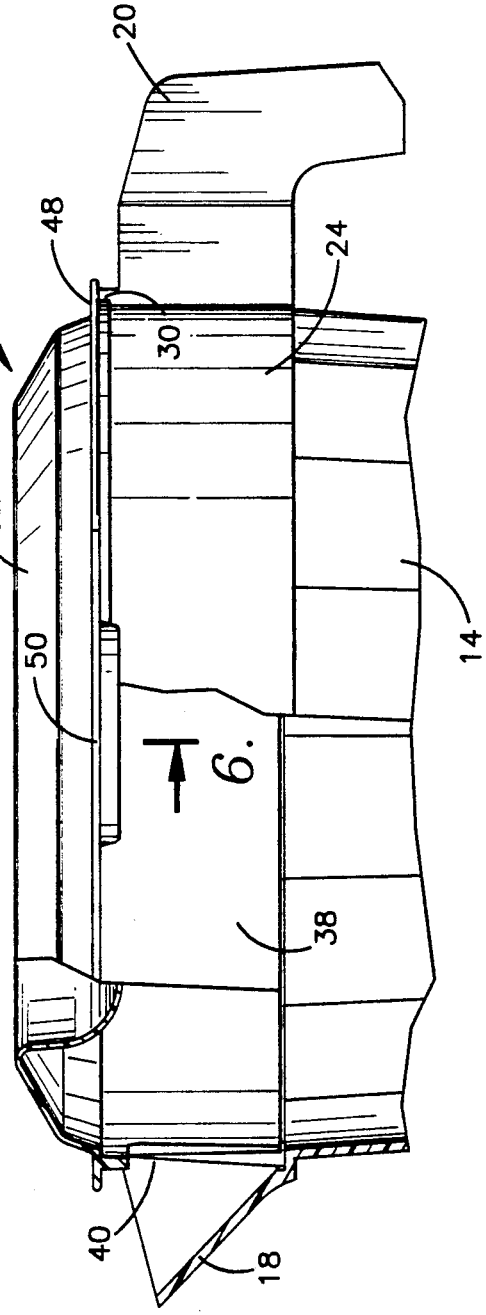
FIG. 5 is a fragmentary side elevational view showing the lid in place on the pitcher and rotated 90° from the position of FIG. 5 to lock the lid in place, with portions shown in section for purposes of illustration.

In accordance with the present invention, the top rim of the container body 14 is provided with a circular lip 22. As best shown in FIGS. 4–6, the lip 22 projects outwardly from the top end of a circular band 24 which forms the top portion of the body of the pitcher. The lip 22 terminates in an outer edge which is identified by numeral 26 in FIGS. 3 and 4.

With particular reference to FIG. 3, the lip 22 is provided with a pair of diametrically opposed cutouts 28 and 30 which are essentially interruptions in the lip. Cutout 28 is adjacent to and directly above the spout 18. The other cutout 30 is adjacent to and directly above the handle 20. Except for the cutouts 28 and 30, the lip 22 extends continuously around the top rim of the pitcher 12.

As best shown in FIGS. 1 and 2, the lid 10 has a generally circular main body 32 having a recessed central portion 34. Extending across the recessed portion 34 is a handle 36 which facilitates grasping and turning of the lid, as will be explained more fully. Extending downwardly from the periphery of the main body 32 of the lid is a cylindrical skirt 38 having a size to fit closely inside of the top portion of the pitcher adjacent to the band 24 (see FIG. 6). A generally rectangular opening 40 (FIG. 2) is formed through the skirt 38. The width of opening 40 is approximately the same as the width of the spout 18 so that when opening 40 is aligned with the spout, liquid is able to flow through the opening 40 and the spout 18 into glasses or other containers. At a location diametrically opposite the opening 40, a plurality of vertical slots 42 (FIG. 2) are formed through the skirt 28 and are spaced slightly apart to provide a grate configuration. When the slots 42 are aligned with the spout 18, liquid is able to be poured from the pitcher through the spout 18, while the slots 42 are too narrow to allow ice cubes and other relatively large solid objects to pass through them.

With reference to FIG. 1, the main body of the lid 10 is provided on its top surface with a pair of indicia 44 and 46 which indicate the locations of the respective openings 40 and 42. Indicia 44 is located near the periphery of the main body 32 at a location in alignment with the opening 40. The indicia 44 is visually distinct from the indicia 46 and identifies the location of opening 40. For example, the indicia 44 may be a rectangle to pictorially represent the rectangular opening 40. The other indicia 46 is diametrically opposed to indicia 44 and is located near the periphery of the main body 32 in alignment with the slots 42. By way of example, the indicia 46 may pictorially represent a plurality of slots to indicate the location of slots 42.

A flat flange 48 projects outwardly from the periphery of the main body 32 of the lid and extends continuously around the lid. When the lid 10 is applied to the top of the pitcher, the outer edge of the flange 48 lies directly above the outer edge 26 of lip 22, as best shown in FIG. 4.

With reference again to FIG. 1 in particular, a pair of lugs 50 are formed on the flange 48 at diametrically opposed locations. The lugs 50 project outwardly beyond the outer edge of the flange 48 and are centered at locations spaced 90° away from the openings 40 and 42. Each lug 50 has an arcuate cutout 52 formed through it. At a location immediately outwardly of the arcuate opening 52, each lug 50 has a downwardly projecting hook 54. As shown in FIG. 6, each hook 54 has a downwardly extending leg 56 which terminates in an inwardly turned hook tip 58.

In use, the pitcher 12 can be filled with liquids when the lid 10 is removed. The lid can be applied to the pitcher by holding the lid in a rotative orientation in which the lugs 50 are aligned with the cutouts 28 and 30. The lid can then be moved downwardly toward the pitcher with the skirt 38 fitting closely inside of the top portion of the pitcher and the hooks 54 passing through the cutouts 28 and 30. Once the lid has been lowered far enough that its flange 48 is on top of the lip 26, the lid can be rotated in order to lock it in place on the pitcher. As the lid is rotated, the hooks are rotated with it such that the hook tips 58 fit closely beneath the lip 22 and interlock with the underside of the lip. The legs 56 are located against the outer edge 26 of the lip when the lid has been rotated to the locking position. The interlocking of the hooks 54 with the lip 22 secures the lid in place on top of the pitcher and prevents it from inadvertently dislodging from the pitcher when the contents of the pitcher are being poured.

When the pitcher is not in use, the lid is preferably rotated to a position in which the spout 18 is blocked by the skirt 38. This keeps odors from escaping from the contents of the pitcher. The spout 18 is blocked by skirt 38 whenever the lid is in a rotative position wherein both openings 40 and 42 are misaligned with the spout 18.

When the contents of the pitcher are to be poured, the lid is rotated until either the opening 40 or the slots 42 are aligned with the spout 18. In this position, the lugs 50 are displaced arcuately by 90° from the cutouts 28 and 30. Consequently, when either one of the pour openings 40 or 42 is aligned with the spout 18, the hooks 54 are displaced by 90° from the cutouts 28 and 30. This assures that the lid is securely locked in place whenever it is rotated to a position in which the contents of the pitcher are to be poured. The presence of the indicia 44 and 46 allows the user to easily select whichever of the openings 40 or 42 is to be used for pouring.

In order to remove the lid 10, it is necessary to rotate the lid until the lugs 50 are in alignment with the cutouts 28 and 30. Then, the lid can simply be lifted, and the hooks 54 pass through the cutouts 28 and 30 as the lid is removed.

In this manner, the lid 10 is secured in place on top of the pitcher and will not fall off when the contents of the pitcher are being poured. At the same time, the lid can be quickly and easily removed when the pitcher is to be filled. The openings 52 in the lugs 50 provide a visual means for indicating improper application of the lid. For example, if the lid is applied and turned improperly such that one of the hook tips 58 is located on top of the lip 22 rather than beneath the lip as intended, the improperly located hook 54 will be visible to the user through the opening 52, thus informing the user that corrective action should be taken. The openings 52 also provide visual access to determine when the hooks 54 are in exact alignment with the cutouts 28 and 30.

The configuration of the hooks 54 with the undercut tips 58 lends itself to formation by conventional plastic molding techniques. In particular, the undercuts can be formed with a straight draw technique in the molding process. This is simpler and less expensive than using a sliding core or unwinding mold technique, and it provides a more definite undercut than a jump technique which provides inadequate definition of the undercut area.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations.

This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A container assembly for holding and pouring liquids, comprising:

a pitcher having an open top and a hollow interior for holding liquids, said pitcher including a handle and a pour spout at said top for pouring of liquids from the pitcher;

a lip extending around said pitcher adjacent the top thereof, said lip projecting outwardly and presenting a plurality of cutouts;

a lid for said pitcher having a lid body and a skirt projecting downwardly from the periphery of the lid body to fit closely inside the pitcher adjacent the top thereof when the lid is applied to cover the top of the pitcher, said skirt having a pour opening therein for pouring of liquids from the pitcher when the lid has a first preselected rotational position wherein said opening is aligned with said spout;

a plurality of lugs on said lid projecting outwardly from the periphery of said lid body; and a plurality of hooks extending downwardly from the respective lugs at locations to align with and pass through said cutouts when the lid has a second preselected rotational position on the pitcher, said hooks being arranged to hook under and interlock with said lip to thereby lock the lid on the pitcher when the lid is rotated from said second position to said first position.

2. The container assembly of claim 1, wherein said first and second rotational positions of the lid are offset by a rotational arc of approximately 90°.

3. The container assembly of claim 1, wherein said cutouts are two in number, one of said cutouts being adjacent to said spout and the other cutout being adjacent to said handle.

4. The container assembly of claim 3, wherein said first and second rotational positions of the lid are offset by a rotational arc of approximately 90°.

5. The container assembly of claim 3, including a second pour opening in said skirt at a location diametrically opposed to the first mentioned pour opening, said second opening comprising a plurality of spaced apart slots located to align with said spout when the lid is in a third rotational position offset from said first position by a rotational arc of approximately 90°.

6. The container assembly of claim 5, wherein said first and second rotational positions of the lid are offset by a rotational arc of approximately 90°.

7. The container assembly of claim 1, including means on said lid for indicating visually when said pour opening is aligned with the spout.

8. The container assembly of claim 5, including means on said lid for indicating visually when the first opening is aligned with the spout and when the second opening is aligned with the spout.

9. In a container for holding and pouring liquids, the combination of:

a pitcher having a pitcher body which is open at the top for receiving liquids;

a spout on said pitcher body for pouring liquids;

a handle on said pitcher body at a location diametrically opposed to said spout;

an outwardly projecting lip on said pitcher body adjacent the top thereof, said lip extending around substantially the entirety of the pitcher body and presenting a pair of diametrically opposed cutouts;

a lid for covering the top of the pitcher body, said lid including a main body and a skirt projecting downwardly from the periphery of the main body to fit closely within the top of the pitcher body;

at least one opening in said skirt through which liquids can be poured when the lid is on the pitcher body in a first preselected rotational position wherein said opening is aligned with said spout;

a pair of lugs projecting outwardly from the periphery of the main body of the lid at diametrically opposed locations; and a pair of hooks extending downwardly from the respective lugs at locations to align with and pass through said cutouts when the lid has a second preselected rotational position on the pitcher, said hooks being arranged to hook under and interlock with said lip to thereby lock the lid on the pitcher when the lid is rotated from said second position to said first position.

10. The combination of claim 9, wherein said first and second rotational positions of the lid are offset by a rotational arc of approximately 90°.

11. The combination of claim 9, wherein one of said cutouts is adjacent to said spout and the other cutout is adjacent to said handle.

12. The combination of claim 9, including a second pour opening in said skirt at a location diametrically opposed to the first mentioned pour opening, said second opening comprising a plurality of spaced apart slots located to align with said spout when the lid is in a third rotational position offset from said first position by a rotative arc of approximately 90°.

13. The combination of claim 12, wherein said first and second rotational positions of the lid are offset by a rotational arc of approximately 90°.

* * * * *